US005334910A

United States Patent [19]

Karsten et al.

[11] Patent Number: 5,334,910

[45] Date of Patent: Aug. 2, 1994

[54] INTERLOCKING PERIODIC PERMANENT MAGNET ASSEMBLY FOR ELECTRON TUBES AND METHOD OF MAKING SAME

[75] Inventors: Kenneth S. Karsten, Bethlehem; Richard C. Wertman, Allentown, both of Pa.

[73] Assignee: ITT Corporation, New York, N.Y.

[21] Appl. No.: 939,306

[22] Filed: Sep. 2, 1992

[51] Int. Cl.[5] ..... H01J 23/087

[52] U.S. Cl. ..... 315/5.35; 29/600; 335/210; 335/306

[58] Field of Search ..... 315/5.35; 29/600, 601, 29/602.1; 335/210, 219, 297, 306

[56] References Cited

U.S. PATENT DOCUMENTS

| | | | |
|---|---|---|---|
| 3,221,204 | 11/1965 | Hant et al. | 315/39.3 X |
| 3,617,802 | 11/1971 | Manoly | 315/3.5 |
| 3,644,771 | 2/1972 | Kennedy et al. | 315/5.35 X |
| 3,971,965 | 3/1975 | Baker et al. | 315/3.5 |
| 4,392,078 | 5/1983 | Noble et al. | 315/5.35 X |
| 4,668,893 | 5/1987 | Amboss | 315/5.35 X |

FOREIGN PATENT DOCUMENTS

| | | | |
|---|---|---|---|
| 117052 | 5/1990 | Japan | 315/5.35 |
| 1020558 | 2/1966 | United Kingdom . | |

*Primary Examiner*—Benny T. Lee

*Attorney, Agent, or Firm*—Arthur L. Plevy; Patrick M. Hogan

[57] ABSTRACT

The present invention is a periodic permanent magnet (PPM) assembly used to produce a focussing field within an electron tube, and the corresponding method of manufacturing the same. The present invention PPM includes producing two opposing semi-cylindrical stacks by alternately stacking semi-annular shaped magnets and pole pieces. Once the two semi-cylindrical stacks are formed, they are joined around the electron tube, such that the various pole pieces and magnets of the two semi-cylindrical stacks align. As a result of the joining of the two semi-cylindrical stacks, a cylindrical periodic permanent magnet assembly is formed around the electron tube in a cost effective and labor efficient manner.

14 Claims, 4 Drawing Sheets

INTERLOCKING PERIODIC PERMANENT MAGNET ASSEMBLY FOR ELECTRON TUBES AND METHOD OF MAKING SAME

FIELD OF THE INVENTION

The present invention relates to a periodic permanent magnet assembly for focusing an electron beam within an electron tube, and the corresponding method of manufacturing the same. More particularly, the present invention relates to periodic permanent magnet structures formed into two opposing semi-cylindrical segments whereby an electron tube is positioned between the opposed segments and the segments are joined in a manner that affords magnetic continuity, thereby creating the desired permanent magnet focusing structure in a labor and cost efficient manner.

BACKGROUND OF THE INVENTION

In electron tubes, such as traveling-wave tubes (TWTs), it is necessary to provide a focusing field for the electron stream as it travels along the tube, from the cathode to the collector. The focusing field, be it magnetic or electrostatic, must be of a strength appropriate to overcome the space-charge forces within the electron tube that would otherwise cause the electron beam to spread. In the past a longitudinal magnetic field was supplied along the length of the electron tube utilizing a electromagnetic solenoid. However, the continuing demands for improved efficiency and reliability, and for weight and size reduction, have resulted in the development of periodic permanent magnet (PPM) structures. As will be recognized by a person skilled in the art, PPM structures focus the electron beam by periodically positioning magnets of opposite polarity along the length of the electron tube, thereby creating a periodically reversing magnetic field which acts to confine the passing electron beam.

Typically, in prior art PPM assemblies, a series of angularly formed pole pieces, non-magnetic spacers and individual ring magnets are stacked on top of one another to form an elongated cylinder in which a linear or semi-linear electron beam device can be placed. In such prior art PPM assemblies, the pole pieces and non-magnetic spacers are fabricated as cylindrical sections, which are joined to create the overall cylindrical shape of the PPM assembly. Typically, the ring magnets are formed as semi-circles and are affixed to either side of the various pole pieces by being either clamped, taped or glued into place. The process joining the pole pieces to the non-magnetic spacers and affixing the ring magnets to the pole pieces, results in an assembly procedure that is inefficient, requiring excessive handling of the PPM assembly and long assembly time.

It is therefore a primary objective of the present invention to set forth a PPM assembly and corresponding method that is both less expensive and less labor intensive to assemble, thereby reducing the cost of manufacturing the PPM assembly and reducing damage to the PPM assemblies caused by excessive handling.

SUMMARY OF THE INVENTION

The present invention is a periodic permanent magnet (PPM) assembly used to produce a focussing field within an electron tube and the corresponding method of manufacturing the same. The present invention PPM includes producing two opposing semi-cylindrical permanent magnet stacks by alternately stacking semi-annular shaped magnets and pole pieces. Once the two semi-cylindrical stacks are formed, they are joined around the electron tube, thereby aligning the various pole pieces and magnets of the two semi-cylindrical stacks. As a result of the joining of the two semi-cylindrical stacks, a cylindrical periodic permanent magnet assembly is formed around the electron tube in a cost effective and labor efficient manner.

The semi-annular pole pieces used to form the first of the two semi-cylindrical permanent magnet stacks, have a male locking member extending from a face surface. Similarly, a corresponding receptacle-is formed in the pole pieces used to form the second semi-cylindrical permanent magnet stack. As the two semi-cylindrical stacks are joined, the male locking members enter and become locked within, the opposing receptacles, thereby permanently joining the first and second semi-cylindrical stacks into the cylindrically shaped present invention PPM.

Each of the semi-cylindrical stacks used to create the present invention PPM are formed by the juxtaposition of semi-annular magnets between the various semi-annular pole pieces. As will be recognized by a person skilled in the art, magnets within a PPM assembly utilize alternating magnets of opposite polarity. As such, the magnets within each semi-cylindrical stack repel one another thereby resisting a stacked orientation. To help hold each magnet into one set position within each semi-cylindrical stack, a groove is formed on each side of the various pole pieces. The grooves formed on the pole pieces correspond in shape to the semi-annular magnets. As such, each magnet passes into the grooves formed into the pole pieces, on either side of the magnet. Consequently, the magnets become entrapped between the various pole pieces and are restrained from moving when influenced by a repulsive magnetic force.

The repulsive magnetic forces created by the various stacked magnets tend to push apart the semi-cylindrical stacks. Consequently, when the various semi-cylindrical stacks are formed, the magnets and pole pieces are stacked in a fixture that holds the stacks together. When the semi-cylindrical stacks are joined around an election tube to form the present invention PPM, the fixtures are removed. The present invention PPM is formed so as to exactly span the electron tube in between the rigid signal input port and rigid signal output port of the election tube. As such, the present invention PPM spans the election tube between the signal input port and the signal output port and is confined therebetween, thereby presenting the present invention PPM from disassembling from the repulsive forces of the component magnets.

The process of forming a PPM assembly around a prefabricated election tube, by sandwiching the election tube between two semi-cylindrical permanent magnet stacks, reduces both the cost and labor of producing electron tubes with PPM assemblies.

BRIEF DESCRIPTION OF THE DRAWINGS

For a better understanding of the present invention, reference is made to the following description of an exemplary embodiment thereof, considered in conjunction with the accompanying drawing in which.

DETAILED DESCRIPTION OF THE PREFERRED EMBODIMENTS

The present invention is a periodic permanent magnet (PPM) assembly used to produce a focusing field within a linear or semi-linear electron beam device such as a traveling-wave tube (TWT). As will be recognized by a person skilled in the art, PPM assemblies are typically cylindrical in form, surrounding the path traveled by the electron beam. The present invention periodic permanent magnet assembly is constructed by stacking a plurality of semicircular magnets with flux guides, or pole pieces to create a semi-cylindrical subassembly. The TWT, or other electron beam device, is then positioned between two of the semi-cylindrical subassemblies as they are joined, thereby creating the needed cylindrical configuration.

Figure 1:
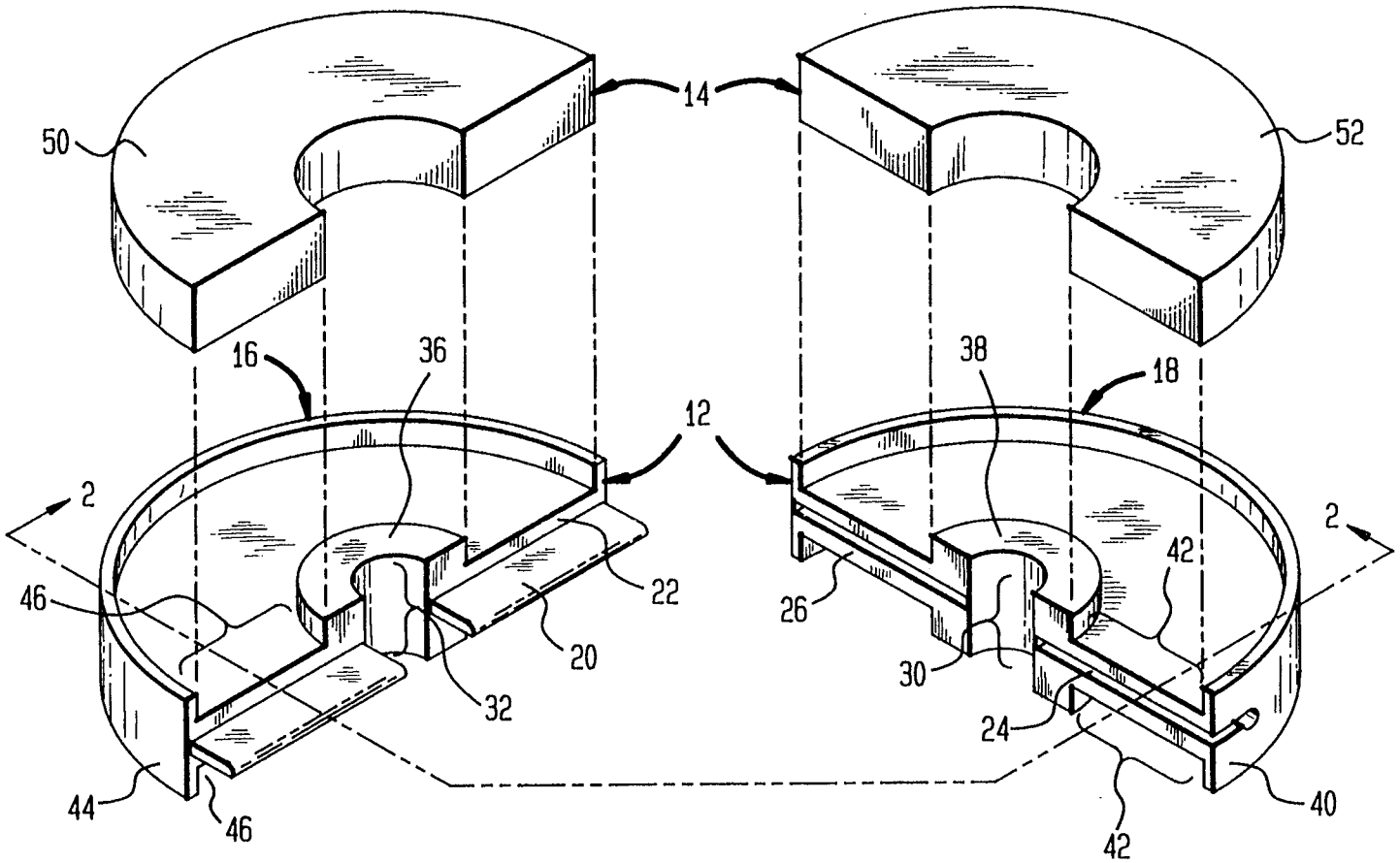
FIG. 1 shows an exploded perspective view of one pole piece and corresponding ring magnets from one exemplary embodiment of the present invention periodic permanent magnet assembly.

In FIG. 1 there is shown one preferred embodiment of a pole piece 12 and a corresponding ring magnet 14 that is used to construct the present invention PPM. Referring first to the pole piece 12, it can be seen that the pole piece 12 is constructed of two semicircular members, including a first pole piece member 16 and a second pole piece member 18. The first pole piece member 16 and the second pole piece member 18 being identical in construction except for the presence of a male locking flange 20 on the face surface 22 of the first pole piece member 16 and the presence of a female receptacle 24 extending into the second pole piece member 18 from a face surface 26 of the second pole piece member 18. As will later be described, the male locking flange 20 of the first pole piece member 16 passes into the female receptacle 24 of the second pole piece member 18, allowing the face surface 22 of the first member 16 to abut against the face surface 26 of the second pole piece member 18, forming a single circular pole piece 12.

Centrally positioned along the face surface 26 of the second pole piece member 18 is a semicircular relief 30. Similarly, a semicircular relief 32 is centrally positioned along the face surface 22 of the first pole piece member 16. When the first pole piece member 16 is joined to the second pole piece member 18, the two semicircular reliefs 30, 32 align, thereby creating a circular aperture concentrically positioned in the center of the pole piece 12. Surrounding the semicircular relief 32 on the first pole piece member 16 is an enlarged semicircular shaped hub 36. Similarly, an enlarged semicircular shape hub 38 is also formed around the semicircular relief 30 on the second pole piece member 18. The semicircular hub 36 on the first pole piece member 16 aligns with the semicircular hub 38 on the second pole piece member 18, as the first and second pole piece members 16, 18 are joined, thereby creating an annular hub concentrically positioned about the circular aperture, formed by the joining of the two semicircular reliefs 30, 32.

Positioned about the periphery of the curved edge of the second pole piece member 18 is an enlarged rim 40. The area between the semicircular hub 38 and the enlarged rim 40 has a reduced width, thereby giving the second pole piece member 18 a substantially I-shaped profile. Consequently, a semicircular channel 42 is formed on either side of the second pole piece member 18, wherein the channel 42 is defined at one end by the presence of the hub 38 and at the opposing end by the presence of the enlarged rim 40. Similarly, the first pole piece member 16 also has an enlarged rim 44 positioned along its curved periphery, thereby giving the first pole piece member 16 a substantially I-shaped profile. Therefore, a semicircular channel 46 is formed on either side of the first pole piece member 16, being defined by the presence of the hub 36 along one end and by the presence of the enlarged rim 44 at the opposing end. When the first pole piece member 16 and the second pole piece member 18 are joined, the enlarged rim 40 of the second pole piece member 18 aligns with the enlarged rim 44 of the first pole piece member 16, thereby creating a continuous circular enlarged rim that circumvents the entire periphery of the pole piece 12. Additionally, the semicircular channel 42 formed on either side of the second pole piece member 18 aligns with the semicircular channel 46 formed on either side of the first pole piece member 16, thereby creating a continuous, angularly shaped channel on either side of the pole piece 12.

The pole piece 12 is constructed of a ferromagnetic material and a ring magnet 14 is joined to each pole piece 12. The ring magnet 14 is formed of two identically shaped semicircular magnets 50, 52, that when combined produce an annular shape. The first semicircular magnet 50 is dimensioned so as to exactly fit within the semicircular channel 46 formed on the first pole piece member 16 of the pole piece 12. Similarly, the second semicircular magnet 52 is dimensioned so as to exactly fit within the semicircular channel 42 formed on the second pole piece member 18 of the pole piece 12. Consequently, when the first and second pole piece members 16, 18 of the pole piece 12 are joined, a continuous ring magnet 14 is formed, held against the pole piece 12 by magnetic force. The presence of the ring magnet 14 in the channel of the pole piece 12, positions the ring magnet 14 between the central hub and the peripheral enlarged rim, thereby restricting the radial movement of the ring magnet 14 on the pole piece 12.

Figure 2:
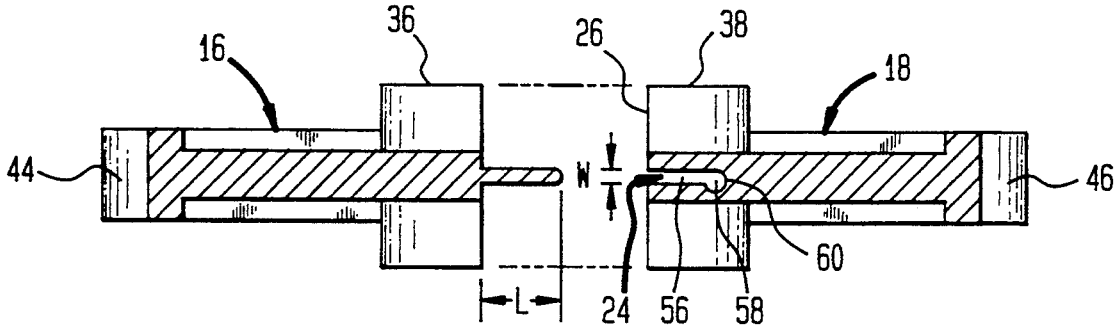
FIG. 2 shows a cross-sectional view of the exemplary embodiment shown in FIG. 1, viewed along section line 2—2.

As has been previously described, a male locking flange 20 extends from the face surface 22 of the first pole piece member 16. The male locking flange 20 is not continuous, but rather is divided in the region of the semicircular relief 32. On the face surface 26 of the second pole piece member 18, a female receptacle 24 is formed so as to allow for the passage of the male locking flange 20 therein. Referring to FIG. 2 it can be seen that the male locking flange 20 is unistructurally formed as part of the first pole piece member 16, as such the male locking flange 20 is formed of the same ferromagnetic material as is the first pole piece member 16. The female receptacle 24 is formed as a slot 56 cut from the material of the pole piece second member 18. The slot 56 has a width W that is slightly larger than the thickness of the male locking flange 20. The slot 56 terminates, within the second pole piece member 18, at an enlarged chamber 58 that has a width larger than the width W of the formed slot 56. The overall depth of the slot 56 and enlarged chamber 58 is less than the length L of the male locking flange 20. As the first pole piece member 16 and second pole piece member 18 are joined, the male locking flange 20 enters the female receptacle 24. Since the overall depth of the female receptacle 24 is less than that of the length L of the male locking flange 20, the male locking flange 20 contacts the rear wall 60 of the female receptacle 24, before the face surface 22 of the first pole piece member 16 abuts against the face surface 26 of the second pole piece member 18.

Figure 3:
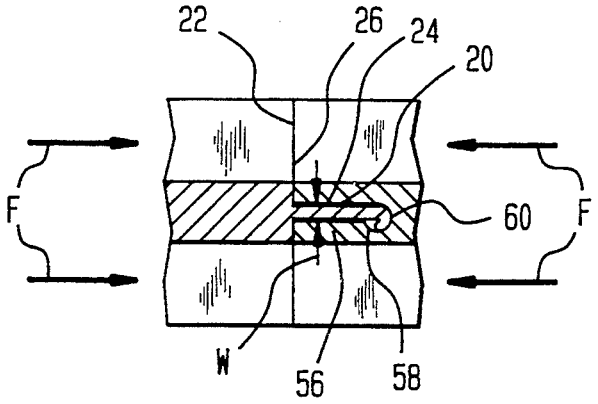
FIG. 3 shows an isolated view of a preferred embodiment of locking arrangement that joins the male and female halves of the pole piece of the present invention.

Referring to FIG. 3 in conjuncture with FIG. 2, it can be seen that the rear wall 60 of the female receptacle 24 is not flat, but rather is curved relative to the approach of the male locking flange 20 through the slot 56. Consequently, when the male locking flange 20 is driven into the female receptacle 24 by compression force F (as designated by the arrows in FIG. 3), the male locking flange contacts the rim wall 60, the male locking flange 20 is deformed along the curve of the wall 60. The male locking flange 20 is therefore deformed in the confines of the enlarged chamber 58. Once deformed, the male locking flange 20 is blunted and consumes more space than it did in its undeformed state. The male locking flange 20 is deformed into a configuration that is larger than the width W of the slot 56 segment of the female receptacle 24. Consequently, the male locking flange 20 cannot be withdrawn through the slot 56 and the male locking flange 20 is permanently locked within the female receptacle 24.

Figure 4A:
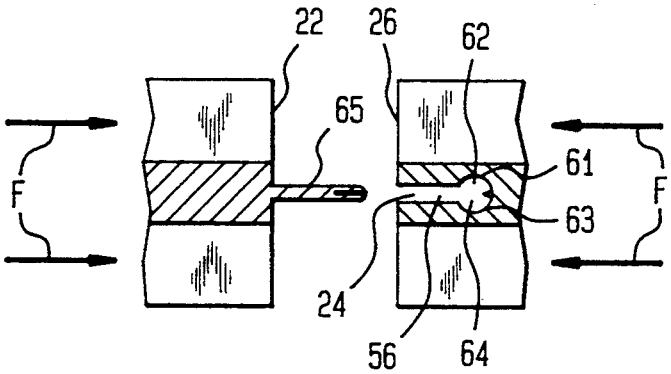
FIG. 4*a* and 4*b* show an isolated view of an alternative embodiment for the locking arrangement.
Figure 4B:
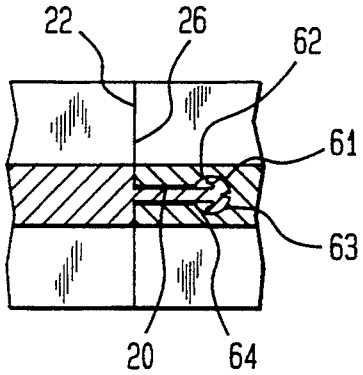

In FIG. 4*a* and FIG. 4*b*, an alternative embodiment of the female receptacle 24 is shown wherein the slot 56 of the female receptacle leads into two enlarged chambers 62, 64. Each of the two enlarged chambers 62, 64 having an opposed sloped rear wall 61, 63. The male locking flange 65 then deforms into both enlarged chambers 62, 64. The male locking flange 65 is split down the middle. As such, when the male locking flange 65 is deformed by compression force F (as designated by the arrows in FIG. 4*a*) against the rear walls 61, 63 each half of the male locking flange 65 deforms into an enlarged chamber 61, 63 in the manner previously described.

Regardless of whether the embodiment of FIGS. 3 or 4*a* are used, it should be recognized that the coupling of the male locking flange into the female receptacle is done so in a manner that promotes metal to metal contact between the first pole piece and second pole piece members 16, 18, thereby promoting magnetic continuity across the entire pole piece 12 when assembled. Furthermore, it should be recognized by a person skilled in the art that there exist many varied techniques to join male flanges into female receptacles. Such techniques may include, but are not limited to, the formation of a locking pawl on the male flange or an interference fit between the male flange and the female receptacle. The shown embodiment of a deformable male locking flange 20 is merely exemplary, being the best contemplated mode for effectively and inexpensively joining the first and second pole piece members 16, 18 of the pole piece 12, however, in the alternative any known joining method can be used.

Figure 5:
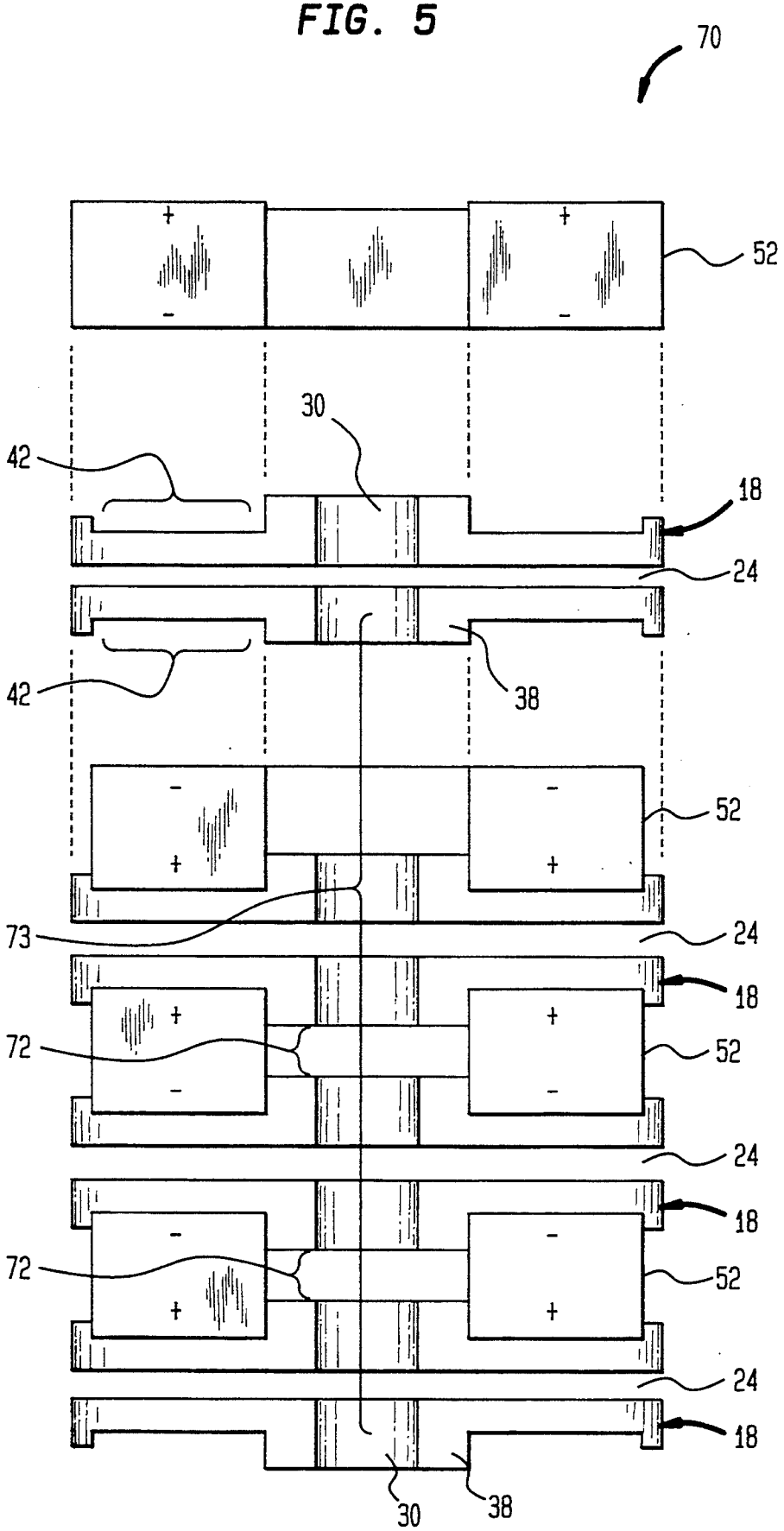
FIG. 5 shows a semi-cylindrical PPM stack subassembly formed by alternately stacking semicircular pole piece segments and magnets so as to form half the present invention PPM stack.

As has been previously stated, the present invention PPM assembly is comprised of a plurality of pole pieces 12 and ring magnets 14 being alternatively stacked atop one another, surrounding an electron beam device. As will be recognized by a person skilled in the art, alternate magnets present in a PPM assembly have reversed faced poles so as to provide periodically reversing magnetic fields along the length of the electron beam device. Referring to FIG. 5, there is shown a semi-cylindrical permanent magnet subassembly 70 being formed by alternatively stacking second pole piece members 18 with its corresponding semicircular magnet 52.

As can be seen, each second pole piece member 18 is coupled to two adjacent magnets 52. However, in the preferred embodiment, each of the magnets 52 contact the second pole piece member 18 with a common pole, either negative (−) or positive (+). Consequently, each magnet 52 is repelled from each second pole piece member 18 by the force of the magnet on the opposite side of the second pole piece member 18. As the second pole piece members 18 are alternatively stacked with the magnets 52, the semicircular hubs 38 of adjacent second pole piece members 18 and the various semicircular reliefs 30 align so as to form a periodic semicircular relief 73 that travels the length of the permanent magnet subassembly 70. Between each semicircular hub 38 exists a gap 72, wherein the gaps 72 are formed by the width of the magnets 52 as compared to the depth of the channels 42 formed in each of the hubs 38. The channels 42, formed on either side of each second pole piece member 18, are dimensioned so as to confine the magnets 52 as the second pole piece members 18 are stacked. Consequently, each magnet 52 becomes confined between the channels 42 of two adjacent second pole piece members 18, as the second pole piece members 18 and the magnets 52 are alternatively stacked. As can be seen from FIG. 5, each channel 42 contacts three surfaces of a magnet 52. As such, the presence of the hub 38 on the inner edge of the magnet 52, the enlarged rim 40 on the outside edge of the magnet 52, and the body of the two second pole piece members 18 above and below the magnet 52 prevent the magnets 52 from moving out of their stacked orientation by the repelling forces of adjacent magnets.

Figure 6:
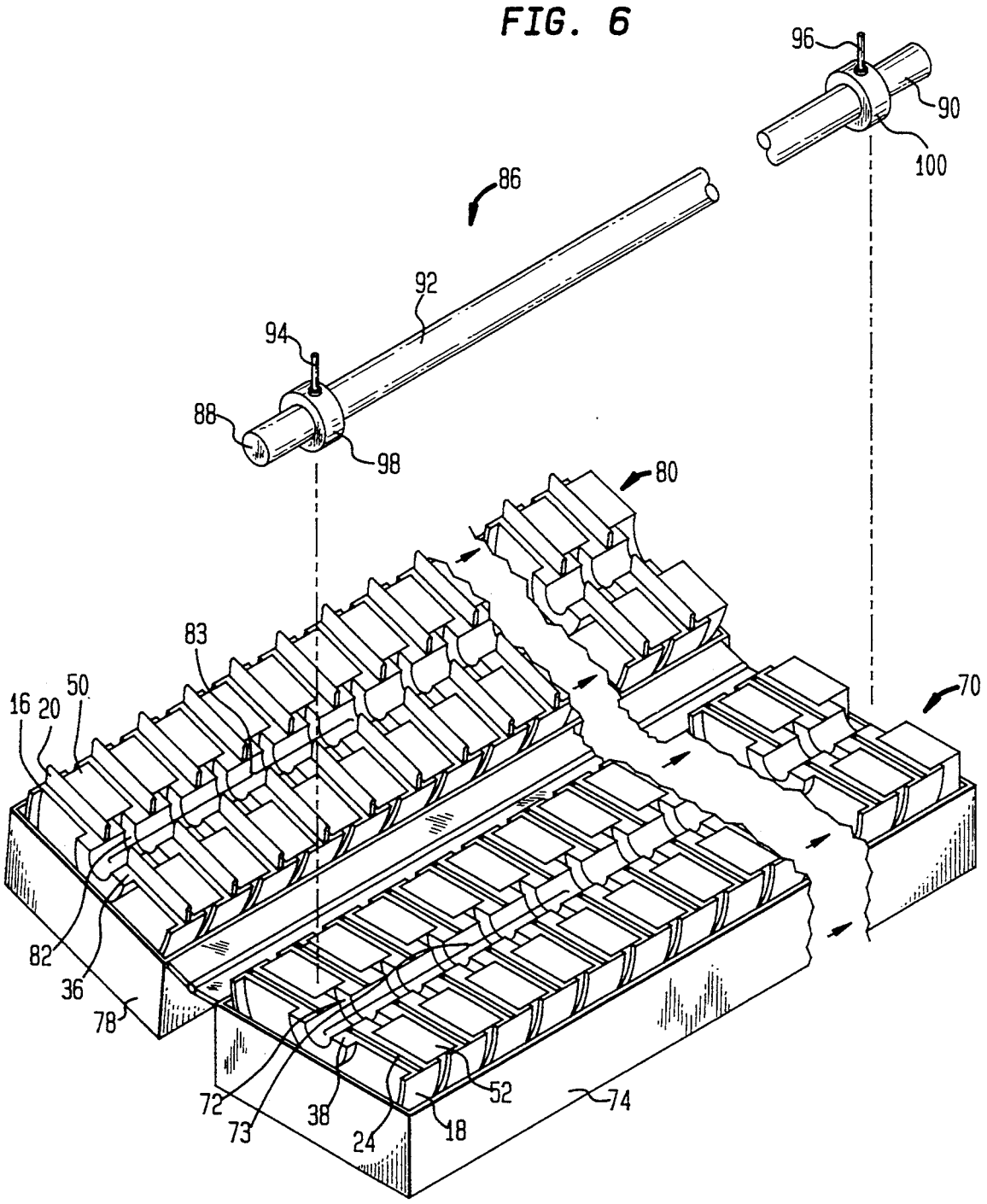
FIG. 6 shows the means by which the present invention periodic permanent magnet assembly is formed and positioned around a traveling-wave tube.

As will be understood by a person skilled in the art, the various second pole piece members 18 and corresponding magnets 52 cannot be alternately stacked into the permanent magnet subassembly 70 unless the various second pole piece members 18 are held together by a force that overcomes the repulsive forces generated by the opposed magnets. In FIG. 6, the means and method of alternately stacking the various pole pieces 12 and ring magnets 14 around a TWT is shown.

Referring to FIG. 6, there is shown a lower fixture 74 into which are placed the alternately stacked second pole piece members 18 and corresponding magnets 52 so as to form a first semi-cylindrical permanent magnet subassembly 70 of a desired length. The fixture 74 confines the size of the permanent magnet subassembly 70 thereby preventing the permanent magnet subassembly 70 from being distorted by the repulsive forces of the various magnets 52. As has been previously explained, as the various second pole piece members 18 are stacked, the central hubs 38 of each adjacent second pole piece member 18 abut and the various center reliefs 30 align, creating a single linear semicircular relief 73 extending across the length of the first permanent magnet subassembly 70 periodic gaps 72 are formed between each of the hubs 38 as a result of the magnets 52 being interposed between each of the hubs 38.

An upper fixture 78 is connected to the lower fixture 74 so as to allow the upper fixture 78 to be folded over the lower fixture 74. In the upper fixture 78, the first pole piece members 16 and corresponding semicircular magnets 50 are alternately stacked in the same manner previously described in regard to the second pole piece members 18, so as to form a second permanent magnet subassembly 80. When stacked, the hubs 36 of each of the first pole piece members 16 and the various center reliefs 32 align, creating a periodic semicircular relief 83 that extends across the entire length of the second permanent magnet subassembly 80. Periodic gaps 82 are formed between each of the hubs 36 as a result of the magnets 50 being stacked between each of the hubs 36. The upper fixture 78 and the lower fixture 74 are aligned so that the various male locking flanges 20 of the first pole piece members 16 pass into the female receptacles 24 of the second pole piece members 18 as the upper fixture 78 is folded atop the lower fixture 74 and the first permanent magnet subassembly 70 engages the second permanent magnet subassembly 80.

Prior to the second permanent magnet subassembly 80 of stacked first pole piece members 16 being placed atop the first permanent magnet subassembly 70 of stacked second pole piece members 18, an electron beam device such as a TWT 86 is placed between the first and second permanent magnet subassemblies 70, 80. Typically, a TWT 86 is comprised of a cathode 88 and collector 90 positioned at opposite ends of an evacuated tube 92. Within the evacuated tube 92 is positioned a helix circuit or other slow wave structure (not shown) having a signal input 94 and an signal output 96, supported by rigid flange members 98, 100, respectively. The radius used to create the semicircular reliefs 73, 83 in the first and second permanent magnet subassemblies 70, 80, correspond to the radius of the evacuated tube 92 used in the TWT 86. Consequently, the evacuated tube 92 of the TWT can be placed into the circular aperture formed by joining the first permanent magnet subassembly 70 to the second permanent magnet subassembly 80.

Typically, in a TWT, the PPM assembly extends the length of the TWT from the signal input 94 to the signal output 96. As such, in the present embodiment the length of the first permanent magnet subassembly 70 and the length of the second permanent magnet subassembly 80 are chosen to correspond to the length of the TWT evacuation tube 92 between the rigid flange members 98, 100 that respectively support the signal input 94 and the signal output 96.

To form the present invention PPM assembly around the shown TWT 86, the evacuation tube 92 of the TWT 86 is placed within the semicircular relief 73 of the first permanent magnet subassembly 70. Once the TWT 86 is in place, the upper fixture 78 is folded over the lower fixture 74 such that the second permanent magnet subassembly 80 engages the first permanent magnet subassembly 70 and the various male locking flanges 20 of the first pole piece members 16 enter the female receptacles 24 of the second pole piece members 18. Once properly positioned, the upper fixture 78 and the lower fixture 74 are compressed toward one another by any known pressing operation. The resulting compression forces the various male locking flanges 20 to deform within the various female receptacles 24, thereby permanently affixing the first permanent magnet subassembly 70 to the second permanent magnet subassembly 80. By affixing the first permanent magnet subassembly 70 to the second permanent magnet subassembly 80, around the evacuated tube section of the TWT 86, the cylindrically-shaped present invention PPM is formed.

As has been previously described, the length of both the first and second permanent magnet assemblies 70, 80 is formed so as to correspond in length with the length of the TWT evacuated tube 92 between the rigid flange members 98, 100. Consequently, when the assembled PPM stack is removed from the upper and lower fixture 78, 74 the rigid flange members 98, 100 contact the first and last magnet, preventing the formed PPM stack from separating under the repulsive forces of the stacked ring magnets. By forming the first and second permanent magnet assemblies 70, 80 by stacking semicircular pole pieces and magnets. A cylindrical PPM can be efficiently assembled around an election tube in a manner that is more efficient and cost effective than existing prior art methods. Additionally, the need for spacing elements and adhesive or tape is removed from the PPM assembly procedure, thereby reducing the time and handling required to manufacture the present invention PPM.

It will be understood that the embodiments described herein are merely exemplary and that a person skilled in the art may make variations and modifications without departing from the spirit and scope of the invention. All such variations and modifications are intended to be included within the scope of the invention as defined in the appended claims.

What is claimed is:

1. A cylindrical periodic permanent magnet assembly through which a length of an electron tube passes, comprising:

a plurality of annular pole pieces, wherein each of said plurality of pole pieces is comprised of a first semi-annular member, having a male locking projection extending therefrom, and a second semi-annular member having a receptacle disposed therein, whereby the receptacle from each said second semi-annular member receives the male locking projection from a corresponding first semi-annular member thereby interconnecting each said first semi-annular member to a corresponding second semi-annular member;

a plurality of ring magnets interposed with said plurality of annular pole pieces such that each of said magnets is respectively juxtaposed between adjacent ones of said plurality of said pole piece.

2. The periodic permanent magnet assembly of claim 1, wherein each of said ring magnets is comprised of a first and second semi-annular magnet, whereby each said first and second semi-annular magnets are alternately disposed between corresponding ones of said first and second semi-annular members respectively.

3. The periodic permanent magnet assembly of claim 2, wherein a magnet retaining means is disposed on each of said first and a second semi-annular members, said retaining means preventing the movement of each said first and second semi-annular magnets from a set position between corresponding ones of said first and second annular members.

4. The periodic permanent magnet assembly of claim 3, wherein each said receptacle disposed in each said second semi-annular member permanently retains a male locking projection from a corresponding first semi-annular member therein, thereby preventing the separation of each said first semi-annular member with each corresponding second semi-annular member.

5. The periodic permanent magnet assembly of Claim 4, wherein each said receptacle includes a narrow slot region that terminates at one end with an enlarged distal chamber having a rearward surface, each said male locking projection passing into said slot region, contacting and deforming against said rearward surface, as said first and second semi-annular members interconnect, whereby the deformation of said male locking projection prevents the retraction of said male locking projection through said slot region, permanently joining corresponding first and second semi-annular members.

6. The periodic permanent magnet assembly of claim 3, wherein each of said pole pieces includes side surfaces that abut against the corresponding ring magnets, and said retaining means includes a groove disposed on each of said side surfaces of said pole pieces, wherein each said ring that abuts against said groove passes into each said groove on said pole pieces, each said groove thereby retaining said first and second semi-annular magnet of a corresponding ring magnet in said set position.

7. A cylindrical periodic permanent magnet device for an electron tube, comprising:

a first semi-cylindrical assembly of interposed first magnet members and first pole pieces, wherein each of said first magnet members is respectively juxtaposed between adjacent ones of said first pole pieces, each of said first pole pieces having a respective locking member extending therefrom; and a second semi-cylindrical assembly of interposed second magnet members and second pole pieces, wherein each of said second magnet members is respectively juxtaposed between adjacent ones of said second pole pieces, each of said second pole pieces having a respective receptacle disposed therein for receiving and retaining a corresponding one of said locking members from said first pole pieces, thereby interconnecting each said first pole piece assembly to a corresponding said second pole piece assembly such that each of said first magnet members and said second magnet members align.

8. The periodic permanent magnet device of claim 7, wherein said electron tube is a traveling-wave tube and includes a signal input and a signal output supported by a first and second rigid flange, respectively, that are a predetermined distance apart, said first semi-cylindrical assembly and said second semi-cylindrical assembly having an overall length corresponding to said predetermined distance between said first and second rigid flange such that said first and second rigid flange confine said first and second semi-cylindrical assembly around said traveling-wave tube, thereby preventing the disassembly of said first and second semi-cylindrical assembly.

9. A method of forming a cylindrical periodic permanent magnet assembly around an electron tube, comprising the steps of:

providing a plurality of semi-annular shaped first pole pieces, each first pole piece having a locking projection extending therefrom;

providing a plurality of semi-annular shaped first magnet members;

alternately stacking said semi-annular shaped first magnet members and said semi-annular shaped first pole pieces thereby forming a first semi-cylindrical assembly wherein each of said first magnet members is respectively juxtaposed between adjacent ones of said first pole pieces;

providing a plurality of semi-annular shaped second pole pieces, each second pole piece having a receptacle formed therein;

providing a plurality of semi-annular shaped second magnet members;

alternately stacking said semi-angularly shaped second magnet members and said semi-angularly shaped second pole pieces thereby forming a second semi-cylindrical assembly wherein each of said second magnet members is respectively juxtaposed between adjacent ones of said second pole pieces;

placing said electron tube in between said first a semi-cylindrical assembly and said second semi-cylindrical assembly; and joining said first semi-cylindrical assembly to said second semi-cylindrical assembly around said electron tube such that said first magnet members and said second magnet members correspondingly align and said first pole pieces and said second pole pieces correspondingly align wherein each said locking projection on said first semi-cylindrical assembly passes into a corresponding receptacle in said second semi-cylindrical assembly thereby interconnecting said first semi-cylindrical assembly to said second semi-cylindrical assembly.

10. The method according to claim 9, wherein each said receptacle has a rear surface and said step of joining further includes deforming each said male projection in each said receptacle by advancing the corresponding male projection against the rearward wall of the corresponding receptacle, thereby preventing the retraction of each said male projection from each said receptacle.

11. The method according to claim 10, wherein said electron tube is a traveling-wave tube and includes a signal input and a signal output supported by a first and second rigid flange, respectively, that are a predetermined distance apart and said step of alternately stacking shaped first magnet members and shaped first pole pieces includes forming said first semi-cylindrical assembly to have a length that corresponds to said distance between said first and second rigid flange on said traveling-wave tube and said step of alternately stacking shaped second magnet members and shaped second pole pieces includes forming said second semi-cylindrical assembly to have a length that corresponds to said distance between said first and second rigid flange, on said traveling-wave tube.

12. The method according to claim 11, wherein said step of joining includes joining said first semi-cylindrical assembly to said second semi-cylindrical assembly around said traveling-wave tube between said first and second flange so that said first and second flange contact and confine said first and second semi-cylindrical assembly thereby preventing the disassembly of said first and second semi-cylindrical assemblies.

13. The method according to claim 12, wherein said step of alternately stacking said first magnet members and said first pole pieces includes positioning said first magnet members and said first pole pieces in a first fixture that maintains said first magnet members and said first pole pieces in a first desired orientation, and said step of alternately stacking said second magnet members and said second pole pieces includes positioning said second magnet members and said second pole pieces in a second fixture that maintains said second magnet members and said second pole pieces in a second desired orientation, wherein said step of joining said first semi-cylindrical assembly to said second cylindrical assembly occurs automatically as said first fixture is advanced against said second fixture.

14. The method according to claim 13, wherein said step of joining further includes compressing said first semi-cylindrical assembly and said second semi-cylindrical assembly together thereby causing each said male projection to contact and deform against a rearward surface in each corresponding said receptacle, preventing each said male projection from being retracted from the corresponding said receptacle.

* * * * *